US005989002A

United States Patent [19]

Nied-Menninger

[11] Patent Number: 5,989,002

[45] Date of Patent: Nov. 23, 1999

[54] BLOCKING-VANE PUMP

[75] Inventor: Thomas Nied-Menninger, Usingen, Germany

[73] Assignee: Luk Fahrzeug-Hydraulik GmbH, Germany

[21] Appl. No.: 08/866,514

[22] Filed: May 30, 1997

[30] Foreign Application Priority Data

May 30, 1996 [DE] Germany ..... 196 23 242

[51] Int. Cl.[6] ..... F04C 2/356

[52] U.S. Cl. ..... 418/248

[58] Field of Search ..... 418/248, 249

[56] References Cited

U.S. PATENT DOCUMENTS

| | | | |
|---|---|---|---|
| 2,786,421 | 3/1957 | Prendergast | 418/248 |
| 3,276,386 | 10/1966 | Fanshawe | 418/248 |
| 3,782,867 | 1/1974 | Gerlach et al. | 418/249 |

FOREIGN PATENT DOCUMENTS 2913110 10/1980 Germany .

3122648 12/1982 Germany .

OTHER PUBLICATIONS

English translation of relevant portions of DE 31 22 648.

English translation of relevant portions of DE 29 13 110.

*Primary Examiner*—John J. Vrablik

*Attorney, Agent, or Firm*—Ostrolenk, Faber, Gerb & Soffen, LLP

[57] ABSTRACT

The present invention relates to a blocking-vane pump having a casing which contains a rotor and in the wall of which there are arranged grooves which receive in each case one blocking vane and which are pressed by a spring against a circumferential surface of the rotor which has control surfaces separated from each other by separating regions. According to the invention, at least four blocking vanes (30) are provided and, distributed over the circumferential surface (20) of the rotor (16), a number of control surfaces (22) amounting to a multiple of 2, two control surfaces (22) being in each case arranged opposite each other and developed identical and the number of control surfaces (22) being greater than the number of blocking vanes (30).

18 Claims, 13 Drawing Sheets

BLOCKING-VANE PUMP

BACKGROUND OF THE INVENTION

The present invention relates to a blocking-vane pump in which vanes are urged against the contoured surface of a rotor and particularly relates to the distributions of surface area on the rotor and of the vanes in the pump.

Blocking-vane pumps of the type in question here are known. They have a casing within which a rotor is placed in rotation. The circumferential surface of the rotor has at least one control surface which—seen in circumferential direction—is limited on both sides by separating regions. The control surface and the separating regions cooperate with at least one blocking vane which is arranged in a groove in the wall of the stationary casing and is pressed against the control surface. By the rotation of the rotor, chambers of variable volume, which are limited by the blocking vanes, are delimited from each other. By the periodic change in the size of the volumes, a fluid is drawn in and then delivered again at a pressure connection. The known blocking-vane pumps have the disadvantage that, upon the drawing in and delivery of the fluid, either radial forces occur which must be absorbed by a corresponding expensive mounting of the rotor or such blocking-vane pumps, particularly in the case of the two-stroke embodiment, exhibit strong volumetric stream pulsation. By the rotary movement of the rotor, the blocking vanes experience a radial movement which is determined by the contour of the circumferential surface of the rotor. In the case of multi-stroke blocking-vane pumps, the total volumetric stream of the blocking-vane pump is determined by a superimposing of the conveyance function of the pump space formed in each case by a control surface and a vane. Due to this superimposing of partial delivery streams, there results a kinematic volumetric stream pulsation which exhibits delivery stream variations.

SUMMARY OF THE INVENTION

It is the object of the invention to create a blocking-vane pump of the type in question here in which the occurrence of radial forces can be minimized and there is at the same time achieved a reduction of the volumetric stream pulsation.

This object is achieved by a blocking-vane pump having at least four vanes in respective grooves in the pump casing and urged against the circumferential surface of the rotor in the bore of the casing. The rotor has a plurality of control surfaces defined between spaced separating regions, wherein there are more control surfaces than blocking vanes, the number of control surfaces is a multiple of two, and identical control surfaces are paired at opposite sides of the rotor. Preferably, four vanes and six control surfaces, uniformly spaced, are provided. Due to the fact that at least four blocking vanes are provided and, distributed over the circumferential surface of the rotor, a number of control surfaces amounting to a multiple of two are formed, each two control surfaces lie opposite each other and are developed identically. The number of control surfaces is greater than the number of blocking vanes. The radial forces caused by the oppositely arranged control surfaces in the corresponding pressure spaces cancel each other out since they are directed in opposition to each other. Advantageously no special mounting need be provided for mounting the rotor so as to absorb the radial forces. The rotor can thus be mounted very advantageously in "flying" manner on the free end of a drive shaft of a driving motor.

In addition to this, it is very advantageous that, due to the at least four blocking vanes and at least six control surfaces, the total volumetric stream is divided over partial volumetric streams which are superimposed on each other and which, corresponding to the rotation of the rotor, are superimposed on each other staggered in time with respect to the total volumetric stream. In this way a uniform volumetric stream is achieved, the volumetric stream pulsation of which is minimized.

In one advantageous embodiment of the invention it is provided that six control surfaces are arranged over the circumferential surface of the rotor which control surfaces preferably cooperate with a total of four blocking vanes. This construction of the blocking-vane pump makes a particularly good distribution of the radial forces over the entire circumference of the rotor possible, the total of the radial forces acting on the rotating shaft of the rotor tending toward zero.

It is in particular very advantageous that, due to the blocking-vane pump of the invention, the application pressure of the separating regions on the casing, which also varied due to the previously occurring radial force variations, is substantially uniform at a minimum level so that any wear of the rotor or of the casing can be minimized. This makes possible a longer operating life of the blocking-vane pump.

In an advantageous development of the invention it is furthermore provided that, at any point in time of the rotation of the rotor, there applies the condition that the sum of the squares of the radial positions of a blocking vane which is just being extended and a blocking vane which is just being retracted is constant and equal to the sum of the squares of the maximum and minimum radial positions of the blocking vanes. In this way the entire delivery behavior of the blocking vanes is very advantageously taken into account as a function of the radial stroke of the blocking vanes. By the special development of the contour, a squared increase of the delivery quantity over the vane stroke is taken into account so that upon the superimposing of partial delivery streams the kinematic volume stream pulsation is reduced drastically.

Other features and advantages of the present invention will become apparent from the following description of the invention which refers to the accompanying drawings.

BRIEF DESCRIPTION OF THE DRAWINGS

The invention will be explained in detail below with reference to an embodiment and the accompanying drawings, in which

FIG. 2*b* shows the dashed line curve in FIG. 2 corresponding to another prior art blocking vane pump;

DETAILED DESCRIPTION OF EMBODIMENTS OF THE INVENTION

Figure 1:
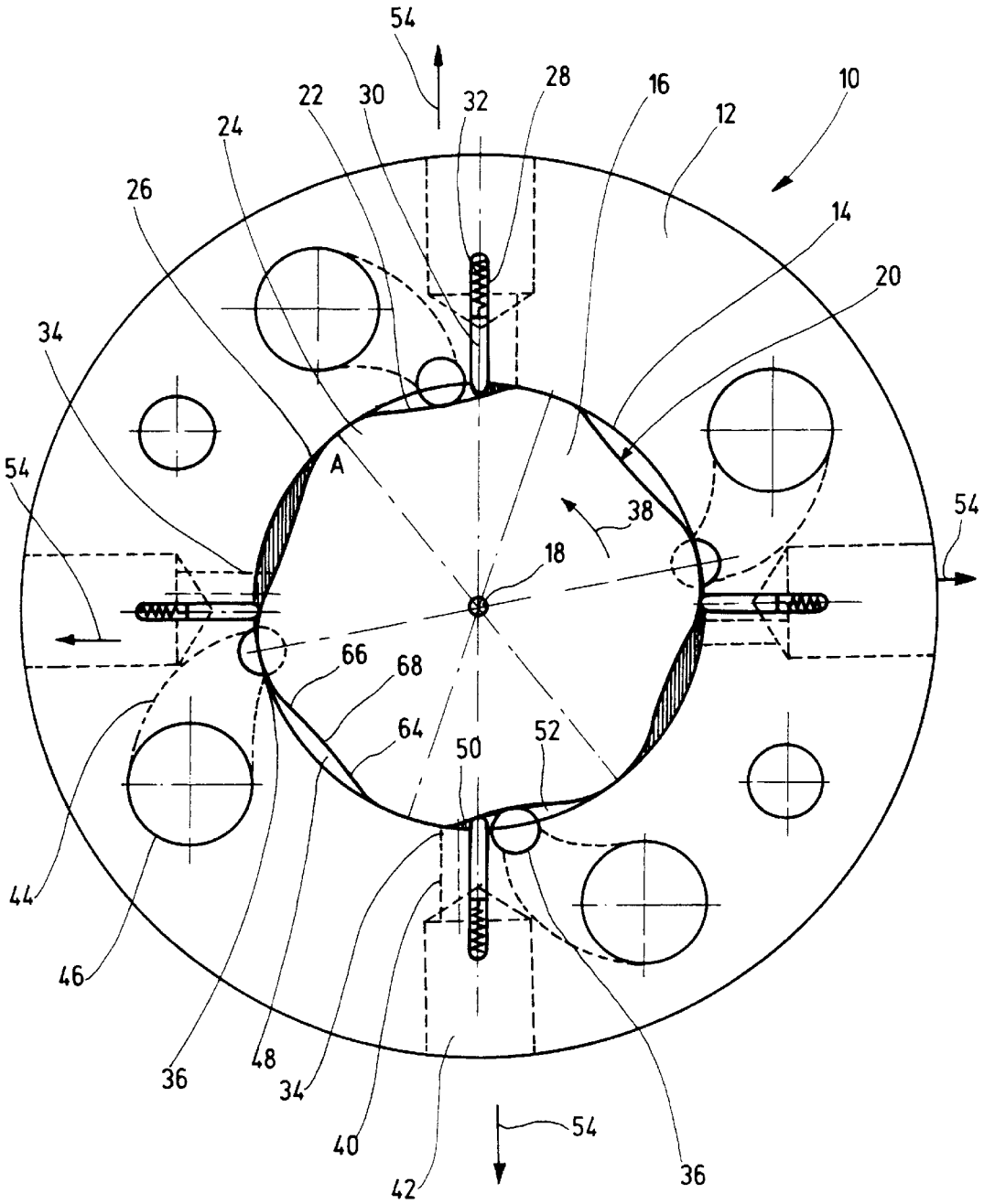
FIG. 1 is a sectional view through a blocking-vane pump.

FIG. 1 shows in section a blocking-vane pump 10. The blocking-vane pump 10 has a casing 12 which is provided with a circular pump chamber 14 defined in FIG. 1 by the internal wall of the casing 12. Within the pump chamber 14 there is mounted a rotor 16 which can be driven by a drive shaft 18. The drive shaft 18 can be driven by a drive device—not shown—for instance, an electric motor, so that the rotor 16 can be placed in rotation within the pump chamber 14. In the embodiment shown, the rotor 16 can be driven in counter-clockwise direction.

The rotor 16 is disk-shaped and has on its circumferential surface 20, which deviates from a circular contour, several, namely in the embodiment shown 6 identically developed control surfaces 22 and separating regions 24. The control surfaces 22 and separating regions 24 are—seen in circumferential direction—always arranged alternating with each other so that each control surface 22 is limited by two separating regions 24. The maximum diameter of the rotor 16 is dimensioned in such a manner that its outside diameter in the region of the separating regions 24 practically corresponds to the inside diameter of the circumferential wall 26 of the chamber 14. In the area of the separating regions 24 the diameter of the rotor 16 is larger than its diameter in the region of the control surfaces 22 which are virtually formed by radially recessed regions. The control surfaces 22 and the separating regions 24 thus form a contour of the circumferential surface 20 which will be discussed in greater detail below with reference to FIGS. 2 to 4.

In the circumferential wall 26 there are provided grooves 28 which are in this case arranged radially to the drive shaft 18 and into which the blocking vanes 30 are inserted. The width of the blocking vanes 30, measured perpendicular to the plane of the drawing in FIG. 1, corresponds approximately to the thickness of the rotor 16. The length of the blocking vanes 30 measured in radial direction is less than the depth of the grooves 28. The thickness of the blocking vanes 30 is somewhat less than the width of the grooves 28, so that the blocking vanes 30 are displaceably mounted and guided in radial direction against the force of an elastic element, for instance a compression spring 32. The blocking vanes 30 are acted on by pressure from the compression spring 32 and pressed against the circumferential surface 20 of the rotor 16. The application surface of the blocking vanes 30 on the rotor 16 is rounded and preferably arc-shaped so that a practically linear contact with the circumferential surface 20 of the rotor 16 results. The pressing force of the compression springs 32 is so selected that the blocking vanes 30 are pressed against the circumferential surface 20 of the rotor 16 at all speeds of the driving motor. In the embodiment shown in FIG. 1 a total of four grooves 28 with the blocking vanes 30 displaceably mounted therein are provided which are in each case arranged spaced from each other at an angle of 90° in the circumferential wall 26 of the casing 12.

The six separating regions 24 are arranged at an angle of 60° over the circumference of the rotor 16 so that the control surfaces 22 located between the separating regions 24 are also arranged staggered with respect to each other by an angle of 60°. The separating regions 24 and the control surfaces 22 all have exactly the same curvature, i.e. the same contour so that in case of a theoretical straight line placed at any desired place through the drive shaft 18 there results at its two points of intersection with the circumferential surface 20 the same distance between the circumferential surface 20 and the circumferential wall 26 of the pump chamber 14 or the drive shaft 18 respectively.

The control surfaces 22 have a first contour section 64 and a second contour section 66 which pass into each other via a section 68 of arc-shaped curvature. Seen in direction of rotation 38 of the rotor 16, the first contour section 64 lies in front of contour section 66. The contour sections 64 and 66 continue into the arc-shaped section 68 in each case from and towards a separating region 24 respectively.

With each blocking vane 30 there is associated a delivery outlet 34 and a suction inlet 36. The delivery outlet 34 is in this case arranged in front of or upstream of the blocking vane 30 seen in the direction of rotation of the rotor 16 indicated by the arrow 38 and the suction inlet 36 behind or downstream of the blocking vane 30. The delivery outlet 34 is formed for example by a hole 40 which opens in the circumferential wall 26 of the pump chamber 14 and which debouches in a pressure connection 42. The suction inlet 36 is formed by a connection duct 44 conducted through the housing 12 and debouching in a suction connection 46. The pressure connections 42, namely four of them in the embodiment shown, which are associated in each case with the blocking vanes 30 are combined into a common pressure connection of the blocking-vane pump 10 within a casing region not shown in FIG. 1. The suction connections 46 which are associated in each case with a blocking vane 30 are also combined into a common suction connection of the blocking-vane pump 10.

The blocking-vane pump 10 shown in FIG. 1 has the following function, in which connection it is clear that the section of the housing 12 shown here is arranged in pressure-tight manner within an overall casing of the blocking-vane pump 10. For this purpose, pressure plates can be provided on both sides of the rotor 16 which make a pressure-tight closure of the pump chamber 14 possible and which have the corresponding openings for the pressure connections and suction connections respectively.

The rotor 16 is placed in rotation by the drive shaft 18. The blocking vanes 30 are pressed by the compression springs 32 against the circumferential surface 20 of the rotor 16. Due to the development of the separating regions 24 and control surfaces 22, the blocking vanes 30 carry out a radial movement (stroke) during the rotation of the rotor 16. In the area of the separating regions 24, the outer circumference of which corresponds practically to the inner circumference of the circumferential wall 26, the blocking vanes 30 are in their radially outermost position. Upon passing a control surface 22, the blocking vanes 30 are pressed radially inward by the spring force of the compression spring 32 corresponding to the contour of the control surface 22. Due to the contour of the control surfaces 22, chambers 48 result in the region of each control surface 22, said chambers having a specific volume. All chambers 48 have equally large volumes.

If a control surface 22 is in the region of a blocking vane 30, the chamber 48 is divided into two areas 50 and 52 by the blocking vane 30 which rests with its rounded edge in sealing manner against the circumferential surface 20. Corresponding to the direction of rotation 38 of the rotor 16, the areas 50 and 52 change their volumes. The area 50, which is in front of the blocking vane in the direction of rotation, changes its volume from a maximum which corresponds to the entire volume of the chamber 48 to a minimum which ideally corresponds to a value of zero. The decrease in the volume over time is determined in this case by the development of the contour sections 64, 66 and 68 of the control surface 22, as will be explained in greater detail below with reference to FIGS. 2 to 4. The area 52 located behind the blocking vane 30 changes its volume from a minimum which ideally corresponds to a value of zero to a maximum which corresponds to the volume of the chamber 48. Due to these variable volumes, a fluid to be conveyed is drawn in within the area 52 from the suction inlet 36 by the enlargement of the area 52 up to the total volume of the chamber 48. Within the chamber 48, the fluid is moved in the direction of the closest delivery outlet 34 and discharged there under pressure. This takes place due to the volume which is being decreased in area 50 so that the fluid under pressure is pressed in the direction of the arrow 54 out of the pressure connections 42.

In the embodiment shown the chambers 48 shown therein on the bottom and on the top respectively have a decreasing area 50 and an increasing area 52. Via the area 50, a discharging of the fluid (shown hatched) into the delivery outlet 34 takes place, while at the same time a fluid is drawn into the area 52 via the suction inlet 36. The chambers 48 shown to the left and right respectively in the drawing are just reaching the blocking vanes 30 so that in the "snapshot" shown said chambers 48 are starting to discharge through the delivery outlet 34.

It is evident from the drawing that precisely opposite chambers 48 or areas 50 and 52 of the chambers 48 have at any point in time during the rotation of the rotor 16 always the same size. In this way there takes place in opposite chambers 48 or areas 50 and 52 of the chambers 48 an equal buildup of pressure and decrease in pressure respectively. The radial forces resulting from these varying pressure conditions are always equally large in precisely opposite chambers 48 and their regions 50 and 52 respectively, and they always have a precisely oppositely directed directional vector so that they cancel each other out. Thus, no transverse forces act on the rotor 16 and its drive shaft 18. There is thus also not required any special mounting for conducting such transverse forces of the rotor 16 or the drive shaft 18 away. The rotor 16 can therefore be very advantageously arranged fixed for rotation on a free end of a drive shaft extending out of a drive device. The mounting of the drive shaft 18 takes place exclusively by its mounting within the drive device, for instance an electric motor.

Due to the mounting of the rotor 16 free of transverse forces, an optimal guidance of the rotor 16 via the separating regions 24 on the circumferential wall 26 of the pump chamber 14 is present. The separating regions 24 therefore have a constant sealing action between two adjacent chambers 48. Furthermore, the material stress for the rotor 16 and the casing 12 is reduced during operation. Thus, during the rotation of the rotor 16 the casing 12 remains substantially free of mechanical stresses.

Due to the development of a total of six chambers 48 which cooperate with four blocking vanes 30, a very low pulsation of the volumetric stream is achieved since the partial volumetric streams made available by the four pressure connections 42 superimpose each other to form one total volumetric stream. Thus, a substantial improvement in the volumetric stream pulsation occurs as compared with the known, for instance two-stroke blocking-vane pumps.

Due to the rotation of the rotor 16, there takes place a virtual superimposing of the delivery volumes conveyed by each of the chambers 48 to form a total delivery stream. As a result of the arrangement of the four blocking vanes 30 and the six control surfaces 22, there occurs a superimposing of partial volumetric streams which are of different size corresponding to the position of the rotor 16 at the moment and which merge at the pressure connection of the blocking-vane pump 10 to form a common volumetric stream.

Figure 2:
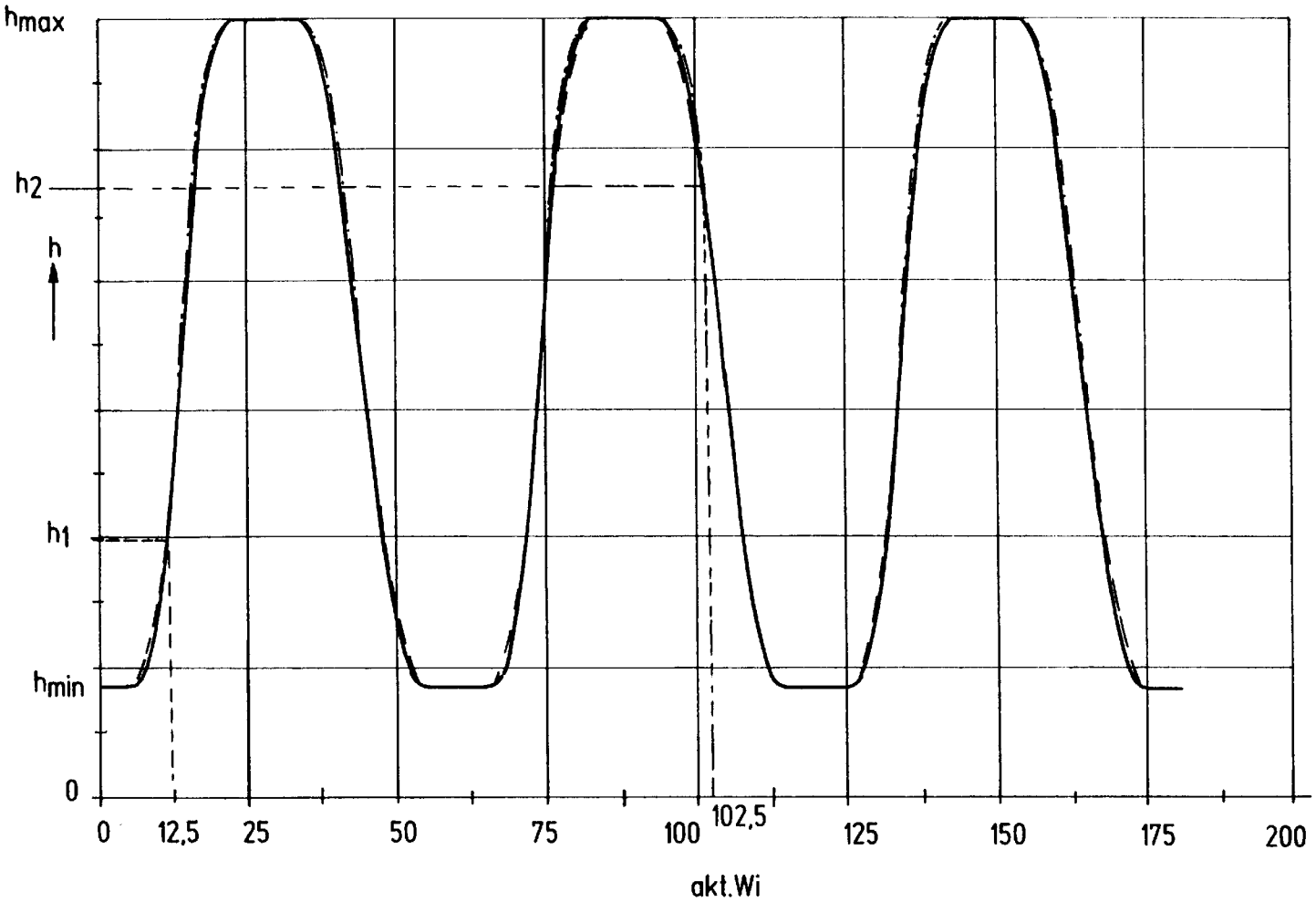
FIG. 2 graphs the radial position of a blocking vane over a half rotation of the rotor in to prior art embodiments and in one embodiment of the invention.
Figure 2A:
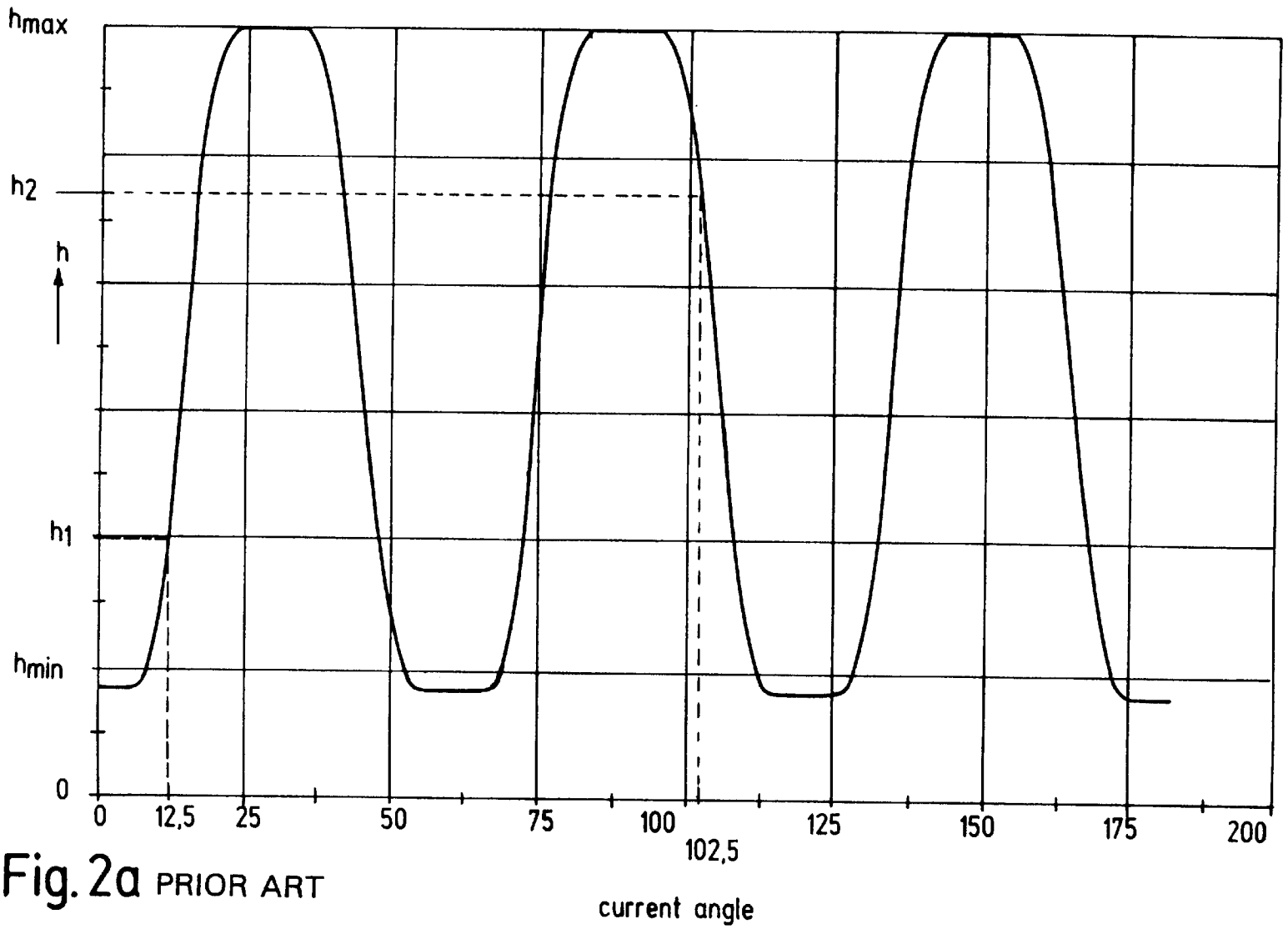
Fig. 2a PRIOR ART
FIG. 2*a* shows the solid line curve in FIG. 2 corresponding to one prior art blocking vane pump embodiment.
Figure 2:
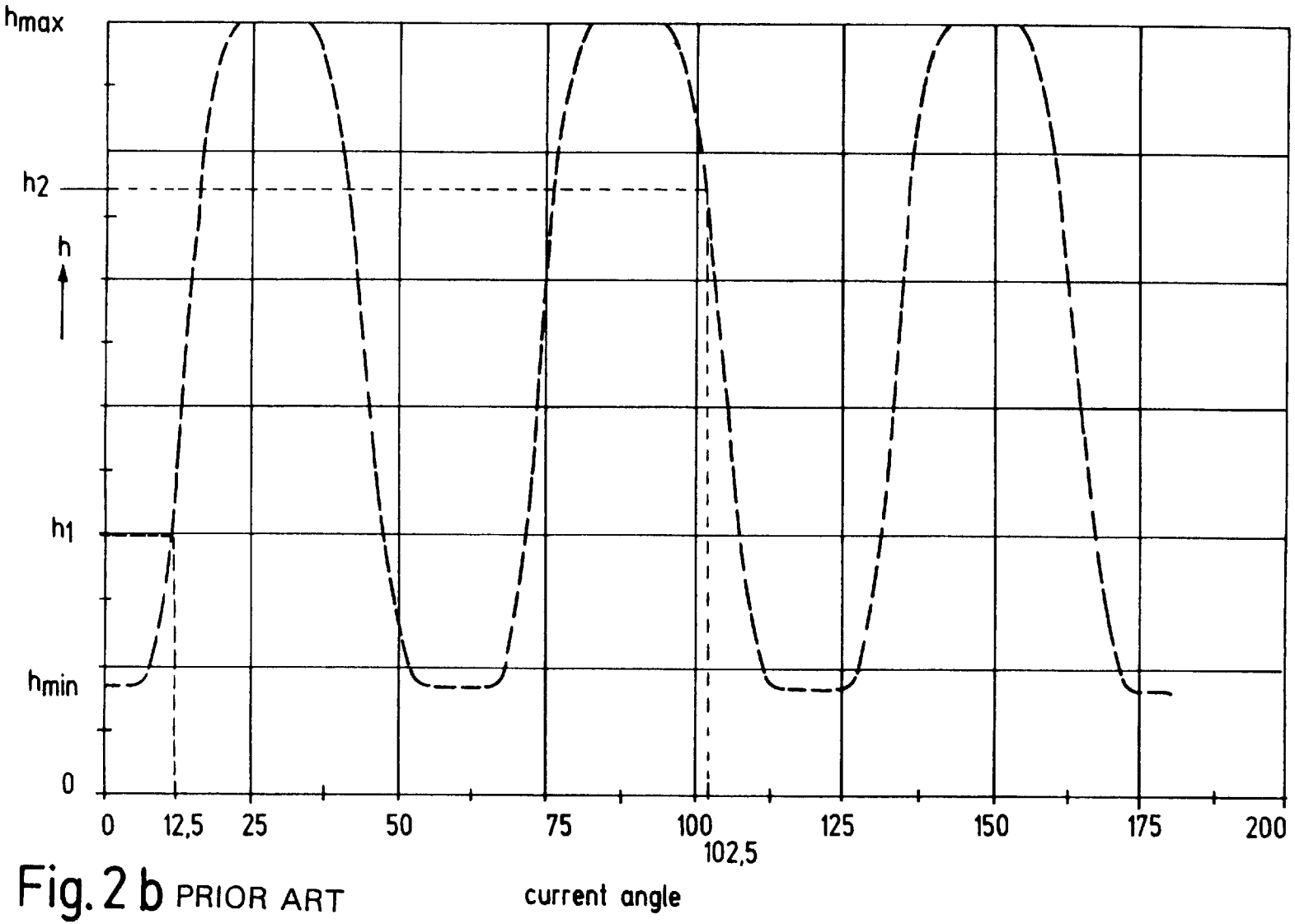
Fig. 2 b PRIOR ART

With reference to FIG. 2, the stroke of a blocking vane 30 over half a rotation of the rotor 16 is indicated. For the sake of clarity, a fixed point A is indicated in FIG. 1 on the rotor 16 which defines a current angle of zero degrees with respect to a blocking vane 30. In the description indicated here by way of example, the point A is located exactly in the center of a separating region 24.

In FIGS. 2, 2*a*, 2*b* and 2*c* the radial position h of a blocking vane 30 over half a rotation of the rotor 16 is indicated, it being clear that in the case of the six-stroke blocking-vane pump shown in FIG. 1 the process is repeated again. The radial position is in this case plotted over the current angle at the time, i.e. from zero to 180°. To illustrate the invention, a total of three characteristics are shown, the solid line of FIGS. 2 and 2*a* and the dashed line of FIGS. 2 and 2*b* representing sinusoidal contours corresponding to blocking-vane pumps of the prior art. The characteristic of the blocking-vane pump 10 of the invention is represented by a dash-dot line of FIGS. 2 and 2*c*. It is evident that the radial position h of the blocking vanes 10 remains in the area of the separating regions 24 at a maximum and in the area of the contour sections 68 of the control surfaces 22 at a minimum. These areas are developed in such a manner that, in this case, no radial movement of the blocking vanes 30 takes place. The course of the contour between the separating regions 24 and the contour sections 68 is so selected that in any position of the rotor 16 the sum of the squares of the radial position h of the blocking vane 30 of a just radially extended blocking vane 30 in the region of a contour section 64 of the control surfaces 22 and of a just radially retracting blocking vane 30 in the region of a contour section 66 of a control surface 22 are constant. This sum of the squares of the radial positions of that extending and that retracting blocking vane 30 is in addition equal to the sum of the squares of the minimum and the maximum radial position h.

For a concrete, arbitrarily selected example this means that if a blocking vane 30 has an angular position of 12.5°, it assumes a radial position $h_1$ and is just extending; a second, following blocking vane 30 then has the angular position 102.5° and a radial position of $h_2$ and is just retracting. The sum of the squares of $h_1$ and $h_2$ is in this connection equally large over the entire course of the contour of the circumferential surface 20. This means that upon a rotation of the rotor 16 the angle positions of the blocking vanes 30 are displaced by exactly the same angular steps. The first blocking vane 30 is in its extending and the second blocking vane 30 in its retracting phase. The sum of the squares of the radial positions $h_1$ and $h_2$ is, in addition to this, equal to the sum of the squares of the minimum radial position $h_{min}$ and the maximum radial position $h_{max}$.

Figure 2C:
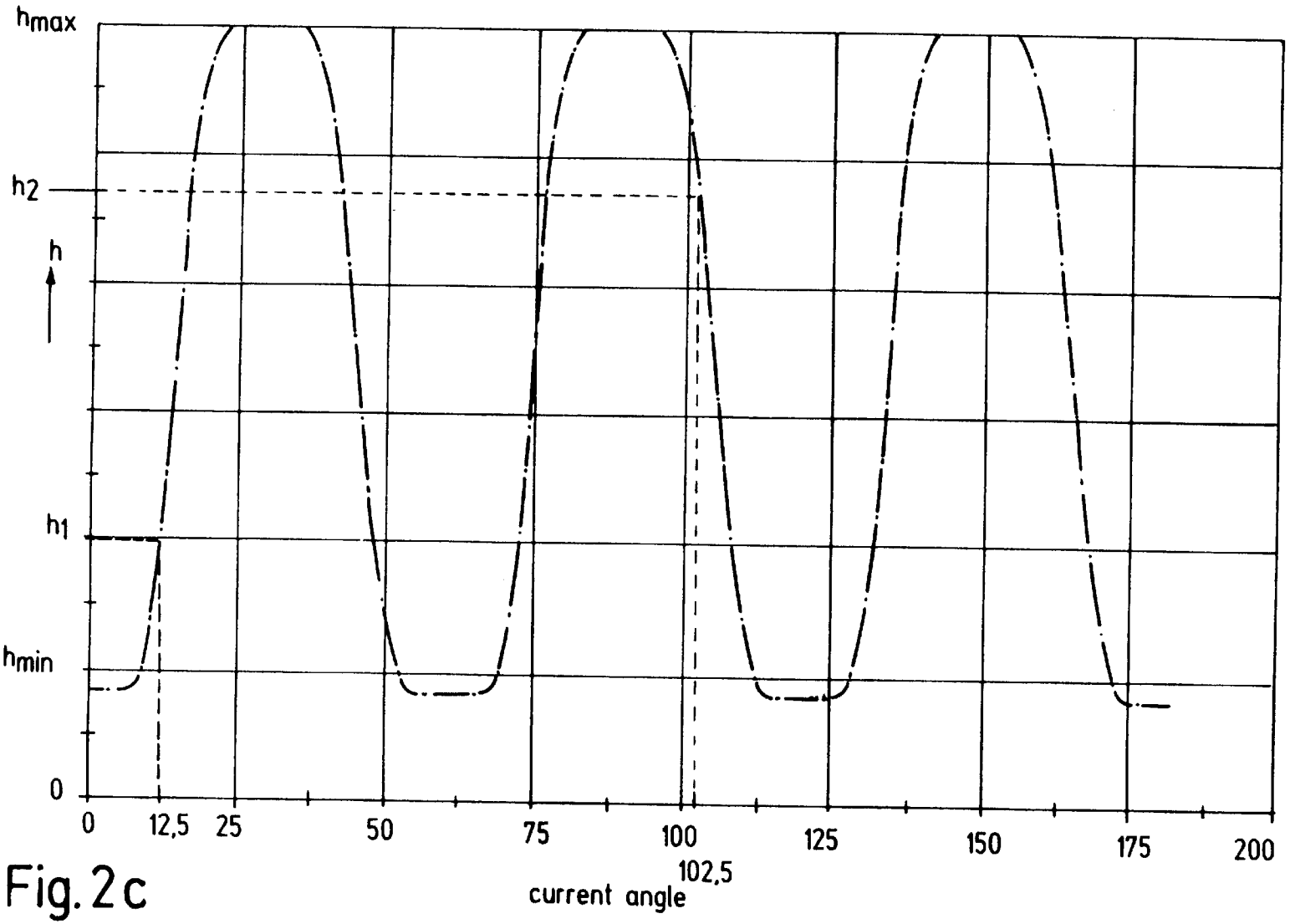
FIG. 2*c* shows the dashed-dot line curve in FIG. 2 for a blocking vane pump embodiment of the invention.

In accordance with the embodiment shown in FIG. 1, four blocking vanes 30 are provided, the same conditions applying for the two additional blocking vanes 30 not taken into consideration in FIGS. 2 and 2*c*.

Figure 3:
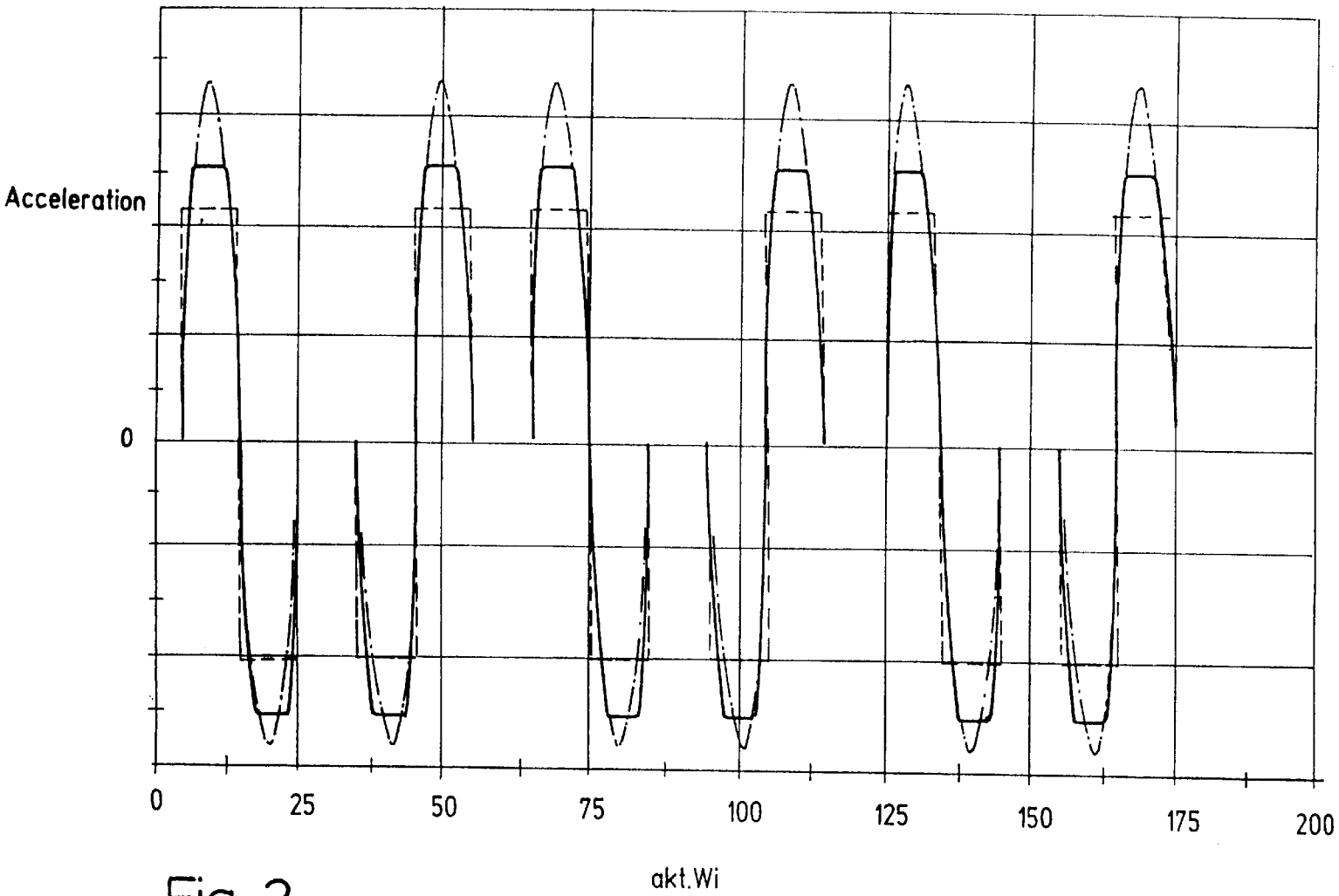
FIG. 3 shows the radial acceleration curve of two blocking vane embodiments of the prior art and one embodiment of the invention.
Figure 3A:
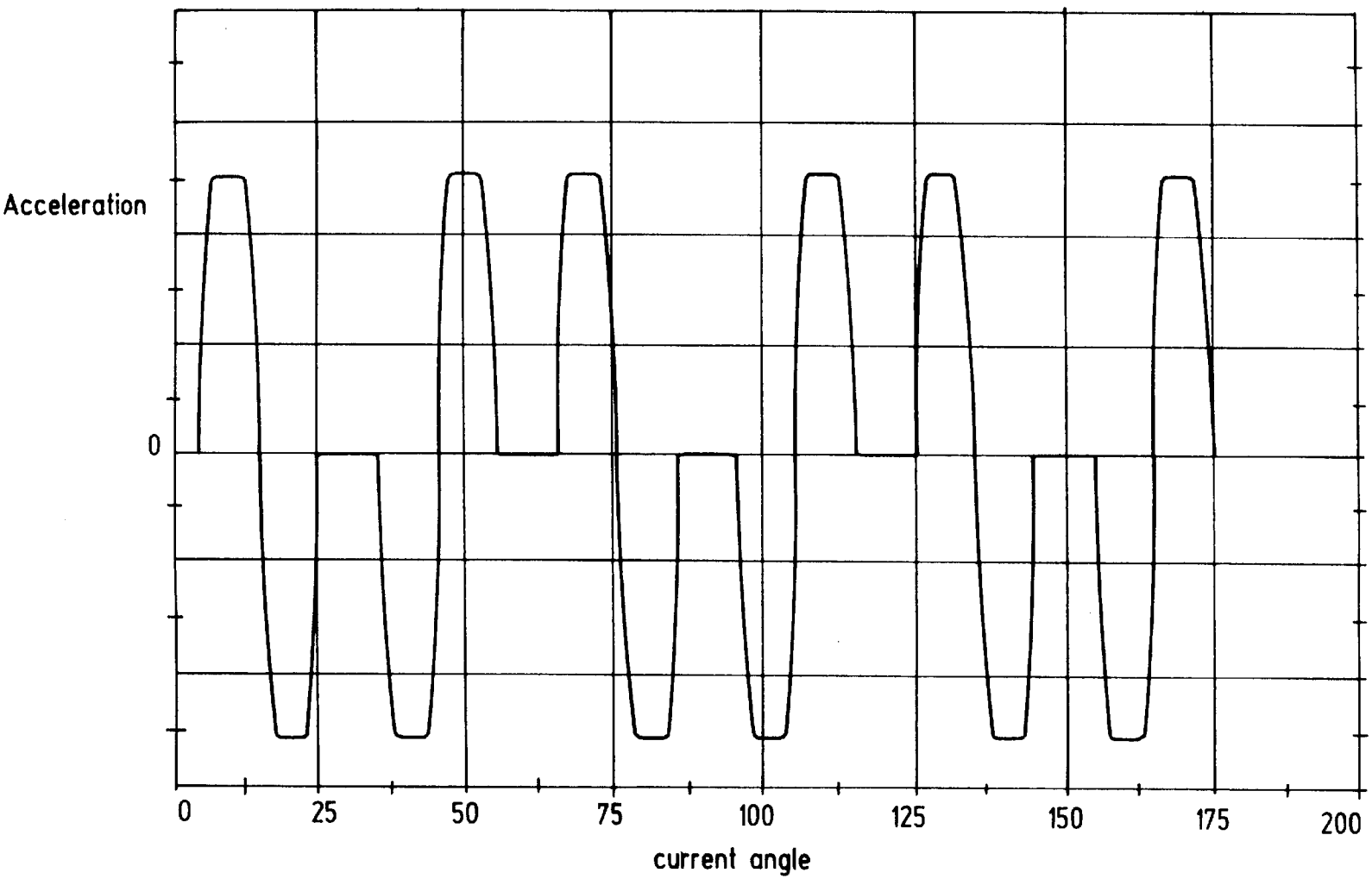
Fig. 3a PRIOR ART
FIG. 3*a* shows the acceleration curve in FIG. 3 of one prior art blocking vane embodiment in solid line.
Figure 3B:
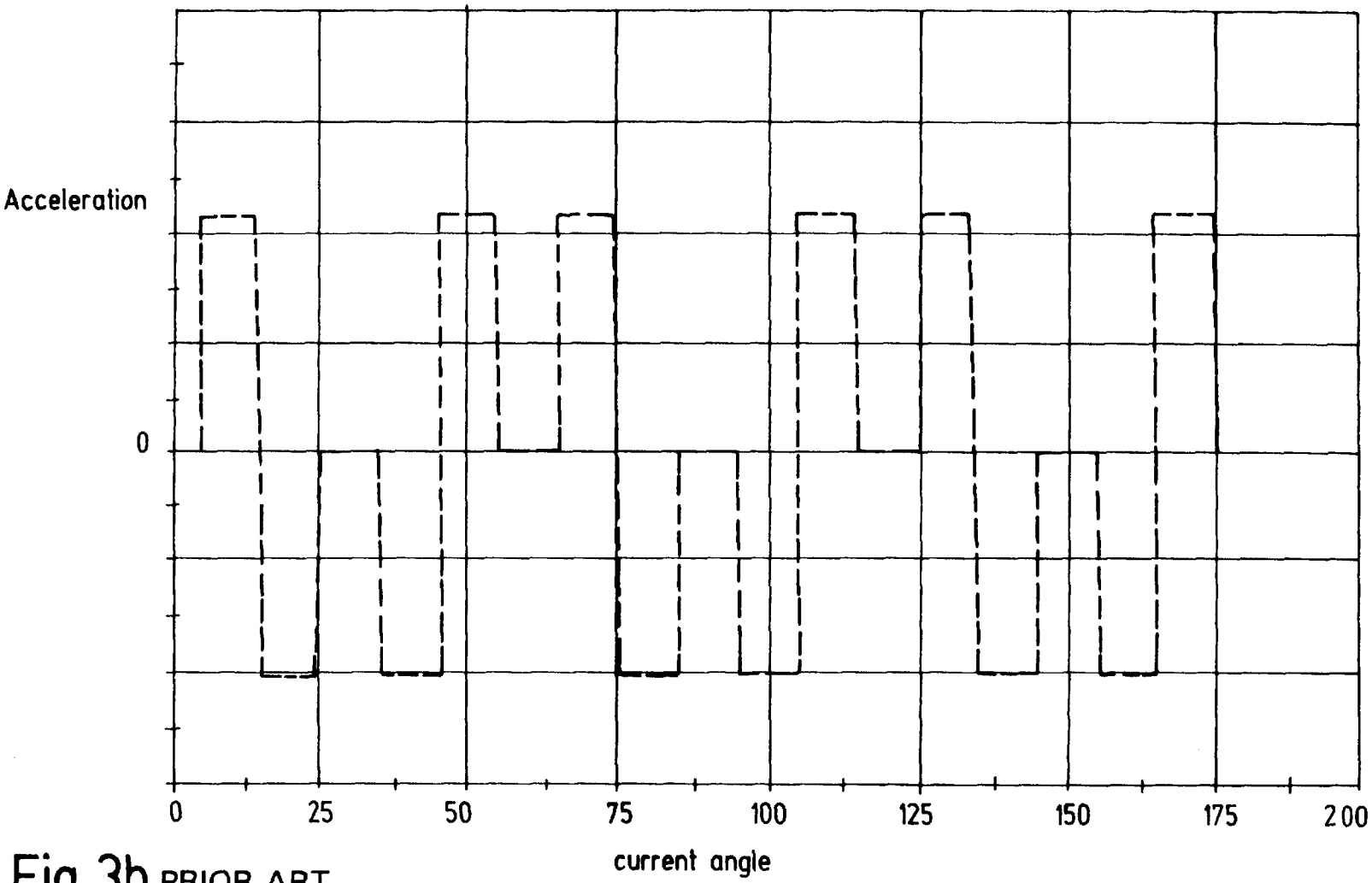
Fig. 3b PRIOR ART
FIG. 3*b* shows the acceleration curve in FIG. 3 of another prior art blocking vane embodiment in dashed line.
Figure 3C:
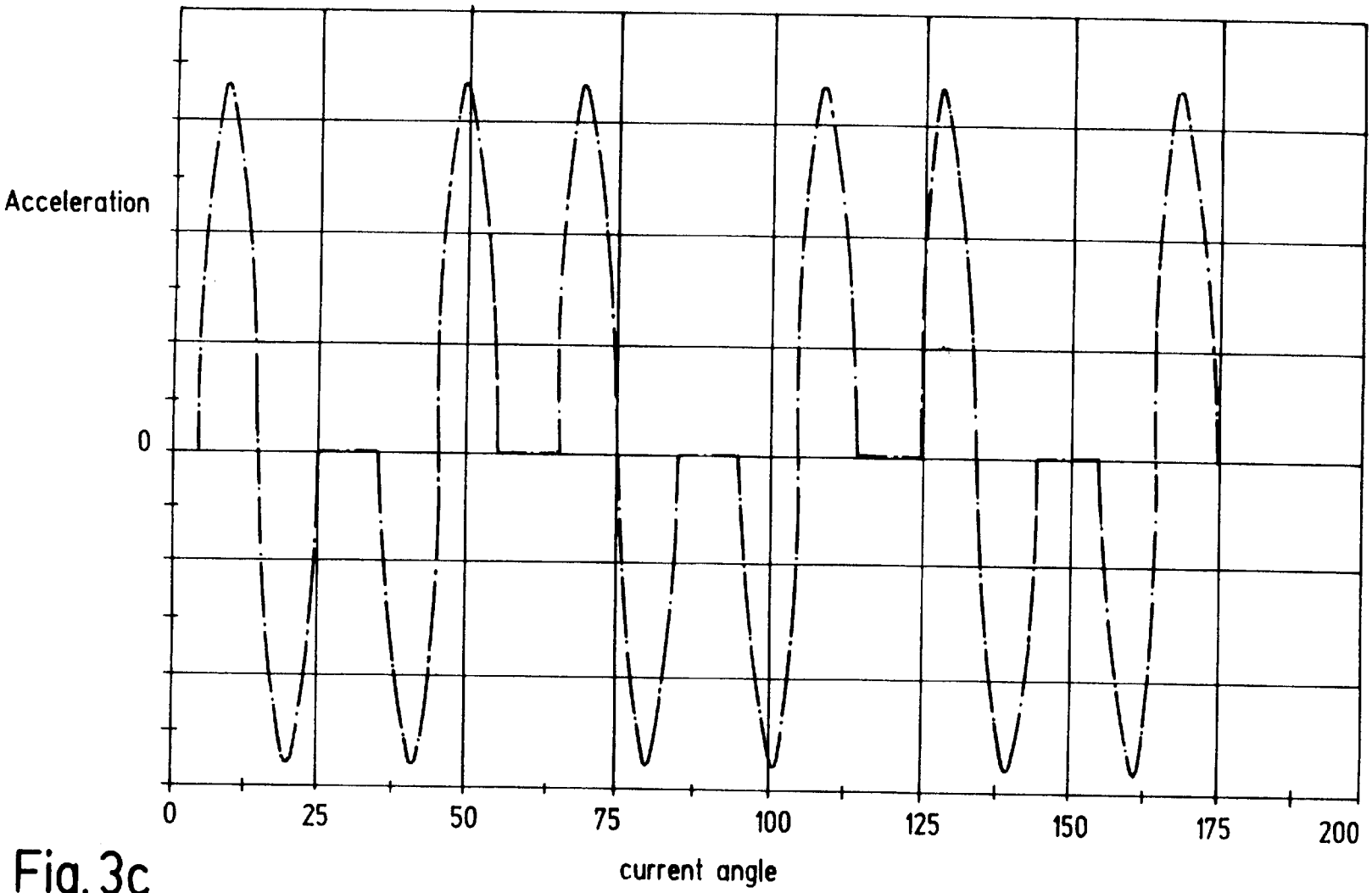
FIG. 3*c* shows the acceleration curve in FIG. 3 of a blocking vane embodiment of the present invention in dash-dot line.
Figure 4:
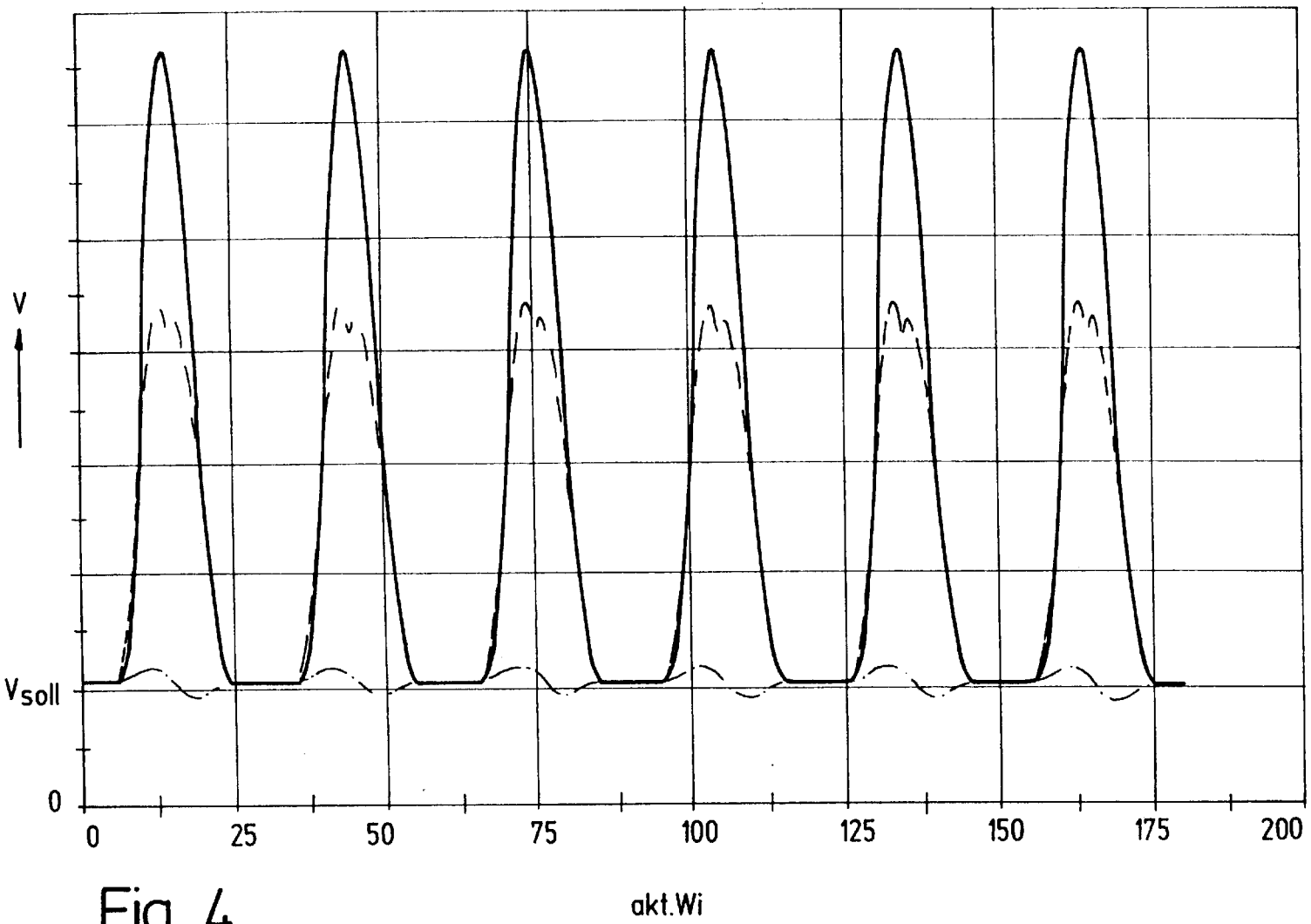
FIG. 4 shows the volumetric stream plotted over the current angle of the rotor for two prior art embodiments and for an embodiment of the invention.
Figure 4A:
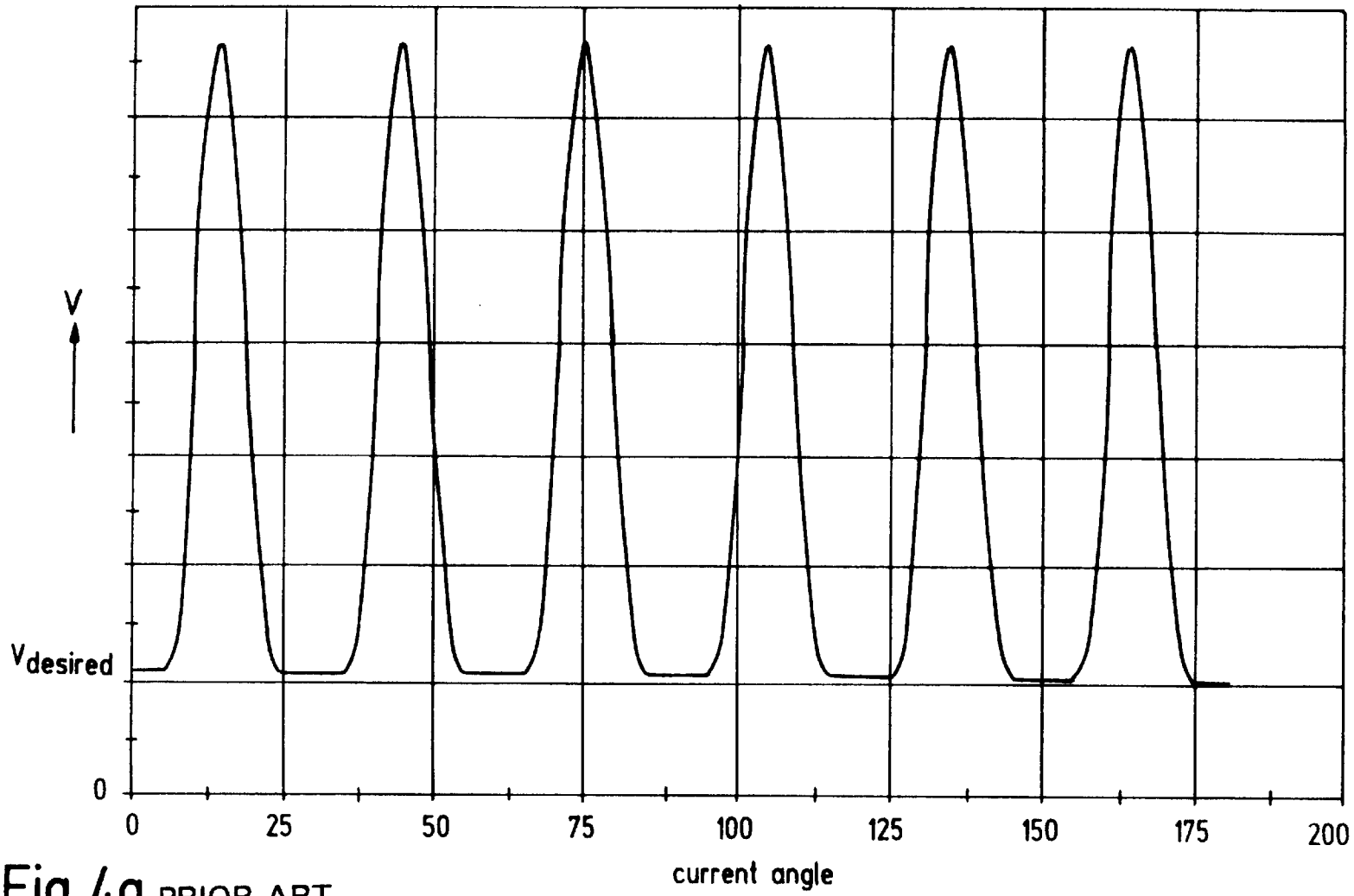
Fig. 4a PRIOR ART
FIG. 4*a* shows the volumetric stream plotted over the angle of the rotor in FIG. 4 for one prior art embodiment, in solid line.
Figure 4B:
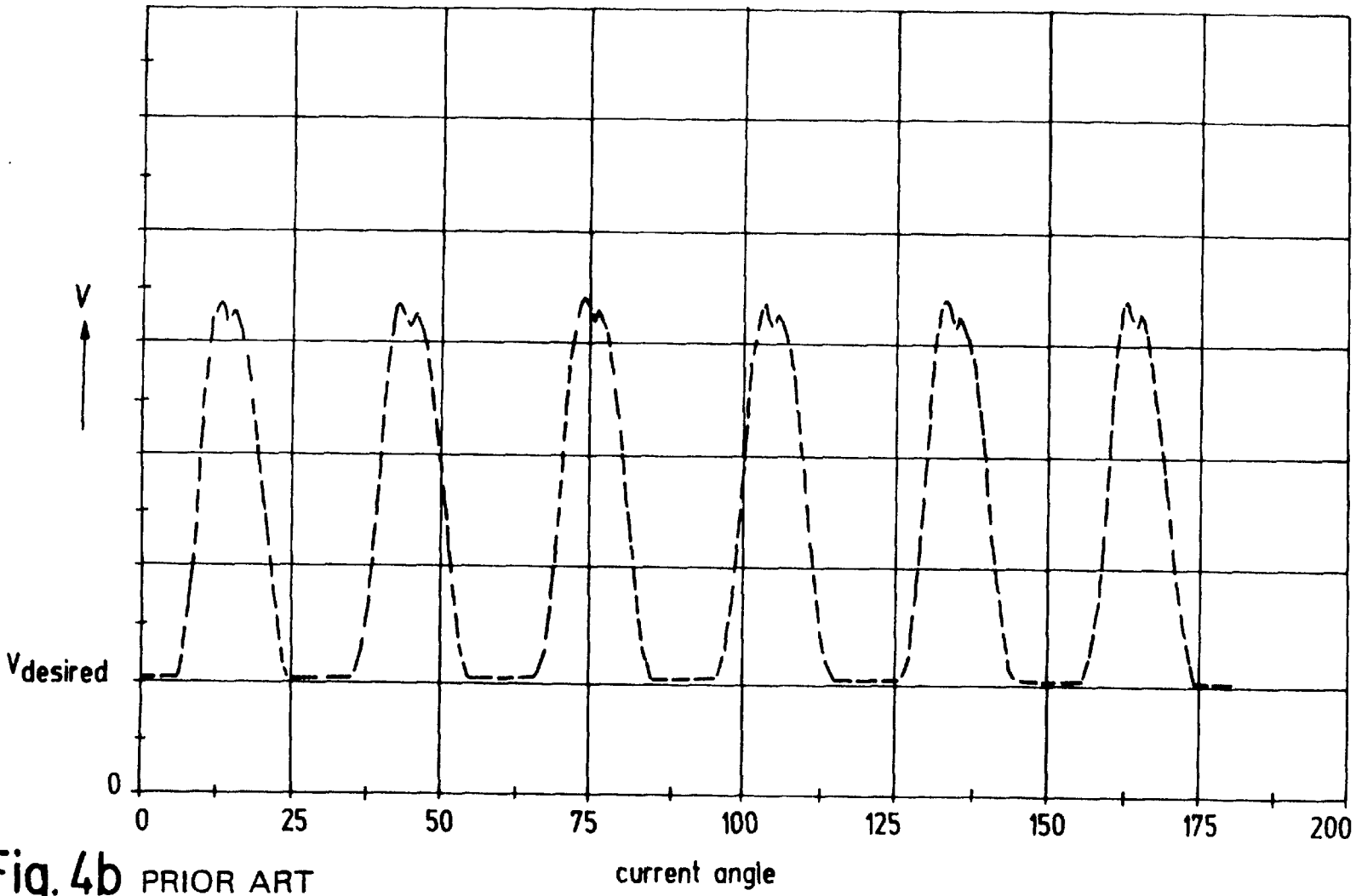
Fig. 4b PRIOR ART
FIG. 4*b* shows the volumetric stream of plotted over the current angle of the rotor in FIG. 4 for a second prior art embodiment, in dashed line.
Figure 4C:
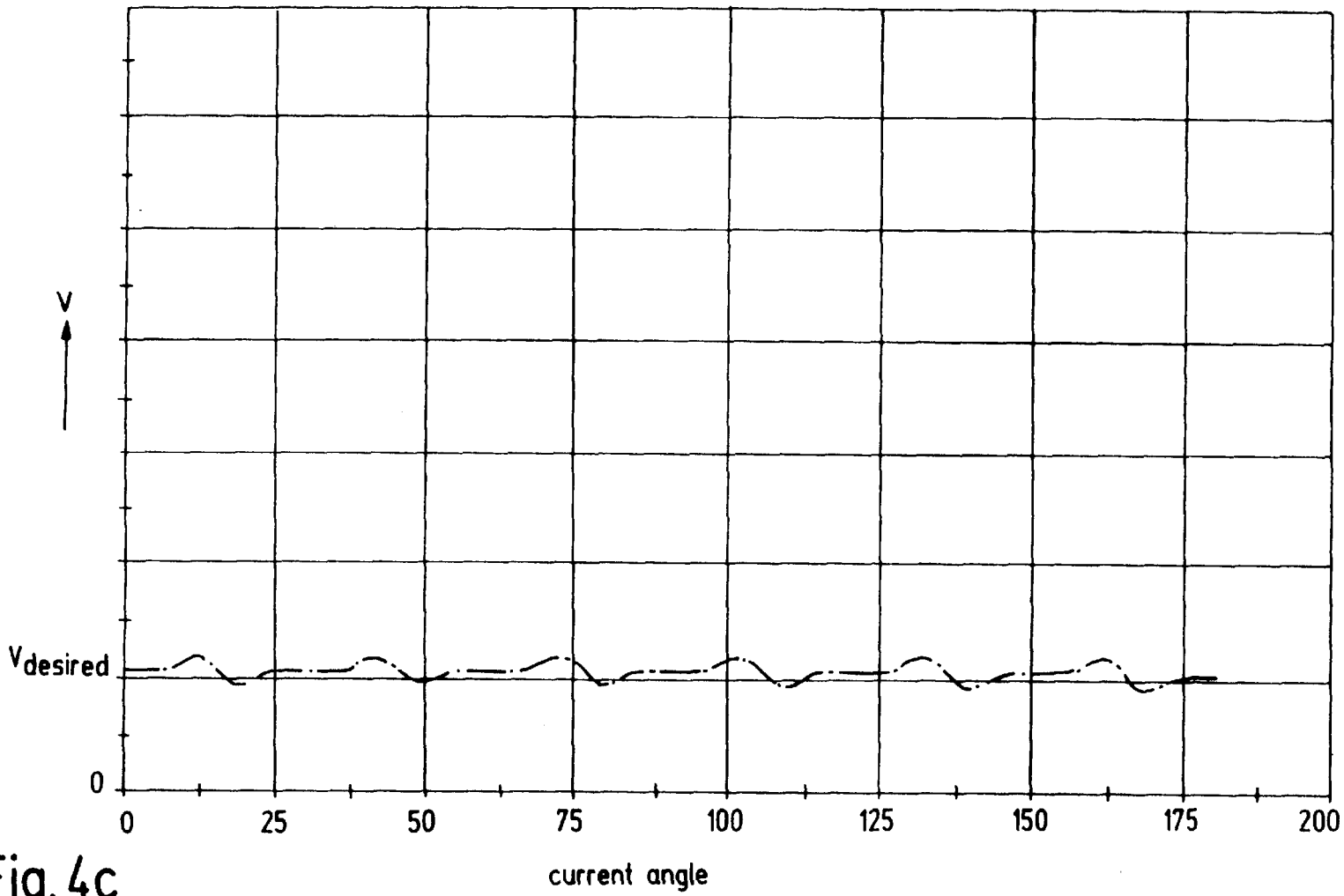
FIG. 4*c* plots the volumetric stream over the current angle of the rotor in FIG. 4 for an embodiment of the invention, in dash-dot line.

In FIGS. 3, 3*a*, 3*b*, 3*c* the radial acceleration curves of the blocking vanes 30 are plotted. The accelerations of the prior art indicated by a solid line in FIGS. 3 and 3*a* and a dashed line in FIGS. 3 and 3*b* are again compared with the acceleration corresponding to the contour of the circumferential surface 20 of the invention indicated by a dash-dot line in FIGS. 3 and 3*c*. When moving through the contour section 64 the blocking vane 30 experiences a negative acceleration to a minimum value from which the acceleration continuously rises through zero up to a maximum value in order continuously to drop again from there to the value zero when reaching the contour section 68. When moving through the contour section 68, which corresponds to the minimum radial position $h_{min}$, the blocking vane 30 does not experience any radial acceleration. It is evident that corresponding to the rotation of the rotor 16 the acceleration rises continuously in the contour sections 66 up to a maximum value, thereupon enters from said maximum value continuously into a negative acceleration through zero to a minimum value and then rises again continuously to zero upon reaching the separating region 24. When passing through the separating region 24, the blocking vane 30 is in its maximum radial position $h_{max}$ and does not experience any radial acceleration there. When comparing the acceleration curves of the contour according to the invention with the contours of the prior art, it is evident that there are no abrupt acceleration jumps, but that the acceleration rises or drops substantially continuously.

In FIGS. 4, 4*a*, 4*b* and 4*c* finally the volumetric stream is plotted over the current angle of the rotor 16. Here again the solid line of FIGS. 4 and 4*a* and the dashed line of FIGS. 4 and 4*b* of the prior art are compared with the dash-dot line FIGS. 4 and 4*c* of the contour according to the invention. It is evident that, due to the contour according to the invention, the kinematic volumetric stream pulsation determined by the contour of the circumferential surface 20 is extremely low. The kinematic volumetric stream pulsation can have values of less than 0.3%. Thus, with the blocking-vane pump having the contour according to the invention, it is possible to adjust a substantially uniform delivery behavior which is free of the volumetric stream variations of the prior art which can be clearly noted here.

In view of everything stated above, it is evident that when using a contour of the circumferential surface 20, as illustrated with reference to the radial position h of the blocking vane 30 in FIGS. 2 and 2*c*, the delivery behavior of the blocking-vane pump 10 can be taken into account as a function of the vane stroke. There is in particular of importance for achieving a minimum kinematic volumetric stream pulsation the taking into account of the squared increase of the delivery quantity over the vane stroke when creating the contour of the circumferential surface 20.

The invention is not limited to the embodiment shown having four blocking vanes 30 and six control surfaces 22 but can be used for each blocking-vane pump 10 in which, as a result of a multi-stroke contour, a superimposing of partial delivery streams takes place so as to form a total delivery stream.

The blocking-vane pump 10 can preferably be used in motor vehicles as transmission pump or as power-steering pump or else as fuel pressure pump. Corresponding to the speed of rotation of the rotor 16, a uniform delivery behavior, i.e. a delivery behavior substantially free of pulsations, can be adjusted within a wide delivery stream range.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A blocking vane pump comprising an annular casing with an internal wall;

at least four grooves in the casing wall extending radially outwardly into the casing and extending along the axis of the casing, distributed around the circumference of the casing wall;

a respective blocking vane disposed in each of the grooves, means biasing each of the vanes radially inwardly into the casing wall and out of the respective groove;

a rotor in the casing rotatable around a rotor axis in the casing, the rotor having a circumferential surface facing outward toward the casing wall and toward the blocking vanes, and the blocking vanes being biased against the circumferential surface of the rotor;

the rotor circumferential surface including control surfaces which are shaped to define respective spaces between the control surfaces of the rotor and the casing wall, the rotor surface further including separating regions between the control surfaces on the circumferential surface of the rotor and the separating regions being of a radial height to seal with the casing wall for defining the spaces, wherein each of the control surfaces is so shaped and the circumferential surface of the rotor is so shaped that at any time during rotation of the rotor, the sum of the squares of the radial position of a then radially inwardly extending blocking vanes and of the radial position of a then radially outwardly retracting blocking vane is a constant equal to the sum of the squares of the maximum and minimum radial positions of the blocking vanes;

there are a plurality of the control surfaces which is greater than the number of blocking vanes, wherein the number of control surfaces is a multiple of two and the control surfaces are paired around the circumferential surface such that two of the control surfaces are symmetrically opposite each other and identically shaped.

2. The blocking vane pump of claim 1, further comprising a respective pressure outlet from the casing for fluid pumped from the casing; and a respective suction inlet to the casing downstream of each vane with respect to the direction of rotor rotation and through which liquid is sucked into the casing.

3. The blocking claim pump of claim 1, wherein the grooves and blocking vanes therein are uniformly spaced around the casing wall.

4. The blocking vane pump of claim 3, wherein each control surface is of a first circumferential length and each separating region is of a second circumferential length.

5. The blocking vane pump of claim 2, wherein the number of grooves and blocking vanes is a multiple of two.

6. The blocking vane pump of claim 2, wherein there are six control surfaces on the rotor and four grooves and four respective blocking vanes in the casing.

7. The blocking vane pump of claim 6, wherein the grooves and blocking vanes are circumferentially distributed at 90° degree intervals around the casing wall.

8. The blocking vane pump of claim 2, wherein the grooves and blocking vanes are circumferentially distributed at 90° degree intervals around the casing wall.

9. The blocking vane pump of claim 8, wherein the control surfaces each occupy about a 60° degree circumferential range of space around the rotor.

10. The blocking vane pump of claim 9, wherein the separating regions are at 60° degree intervals around the rotor.

11. The blocking vane pump of claim 2, wherein the separating regions are at the 60° degree intervals around the rotor.

12. The blocking vane pump of claim 2, wherein all of the control surfaces have identical circumferential size and identical contour between the circumferential ends thereof defined by the respective separating regions thereat.

13. The blocking vane pump of claim 12, wherein a respective chamber is formed between the casing wall and each of the control surfaces defined by the adjacent separating regions, and all of the control surfaces are respectively so shaped that all of the chambers have an equal volume.

14. The blocking vane pump of claim 2, wherein a respective chamber is formed between the casing wall and each of the control surfaces defined by the adjacent separating regions, and all of the control surfaces are respectively so shaped that all of the chambers have an equal volume.

15. The blocking vane pump of claim 2, further comprising a respective delivery outlet for pumped fluid associated with each of the blocking vanes.

16. The blocking vane pump of claim 15, further comprising a common pressure connection to all of the delivery outlets from the pump.

17. The blocking vane pump of claim 2, further comprising a respective suction connection associated with each of the vanes and positioned so that as a first separating region defining a control surface moves past the vane and thereby defines an enlarging chamber between the vane and the first separating region, the suction connection communicates into the enlarging chamber for enabling suction of fluid into that chamber.

18. The blocking vane pump of claim 7, further comprising a common suction connection to each of the individual suction connections associated with each of the vanes.

* * * * *